United States Patent [19]

Gardner et al.

[11] Patent Number: 4,879,848

[45] Date of Patent: Nov. 14, 1989

[54] VIEWING STRUCTURE

[75] Inventors: Kenneth Gardner; Rowland D. Hunt, both of Santa Barbara, Calif.

[73] Assignee: Clamshell Partners, Ltd., Santa Barbara, Calif.

[21] Appl. No.: 230,404

[22] Filed: Aug. 9, 1988

[51] Int. Cl.[4] ..... E04H 3/12

[52] U.S. Cl. ..... 52/8; 52/63

[58] Field of Search ..... 52/6, 8, 9, 10, 64, 52/63, 71

[56] References Cited

U.S. PATENT DOCUMENTS

| | | | |
|---|---|---|---|
| 1,839,233 | 1/1932 | Leffert | 52/8 |
| 2,651,081 | 9/1953 | Storer | 52/8 |
| 4,583,331 | 4/1986 | Hunt | 52/71 |

*Primary Examiner*—John E. Murtagh

[57] ABSTRACT

A viewing structure comprising a plurality of parallel arched frames, pivotally mounted at their ends on the ground, each frame having a front portion, a top portion and a rear portion. The front portion is generally arcuate, with straight top and rear portions joined by a further arcuate portion. The top portion inclines upward and rearward and support pillars are mounted on each top portion, spaced apart along the top portion. Seating members are mounted on the pillars and flooring members are provided between the pillars. The spaces between arches can be filled by fabric panels. The clear space beneath the structure can be used for food concessions, washrooms and other uses.

16 Claims, 8 Drawing Sheets

VIEWING STRUCTURE

BACKGROUND OF THE INVENTION

This invention relates to viewing structures, and in particular to readily assembled and disassembled structures for viewing games, parades and other activities, such as are often called bleachers.

RELATED ART

It is very often required that temporary viewing structures, are required, either as the main veiwing structure or to provide additional viewing area in addition to existing structure. Thus for parades and the like, temperoary veiwing stands may be required. For concerts temporary viewing stands may be required either as the main veiwing stands, or as additional stands.

Often groups, such as popular music groups, travel with some form of temporary stands. The stands may be owned by concert organizers who organize a tour, and the stands travel to each concert place, being put up and dismantled for each show. Conventional stands require a large volume of transportation, are heavy and difficult to erect and dismantle.

SUMMARY OF THE INVENTION

The invention provides a viewing structure or stand composed of a plurality of arches or frames, pivotally mounted at their ends on the ground. Each arch or frame has a front portion, a rear portion and a top portion, the top portion connected at the rear to the top of the rear portion by an arcuate portion. The front portion is also an arcuate portion. In one example the arcuate portion connecting the top portion and the rear portion comprises two arcuate sections, and the front portion is also an arcuate section. The top portion and the rear portion are of a plurality of straight sections. All sections have the same or similar cross-section. Support pillars are mounted on the arches or frames and seating members are mounted on the pillars. Flooring members are mounted between the pillars. The pillars may have two alternate mounting orientations to accommodate two different angles of inclination of the top member. Spaces can be provided under the structure or stand for food concenssions, washrooms and other uses.

BRIEF DESCRIPTION OF THE DRAWINGS

The invention will be readily understood by the following description of certain embodiments, by way of example, in conjunction with the accompanying drawings, in which:

Considering FIGS. 1, 2 and 3 there is shown a viewing stand 10 which comprises a plurality of spaced arches 11. As seen in FIG. 2 each arch has a front portion 12 comprising an arcuate section, a top portion 13 comprising a plurality of straight sections, a rear portion 14 comprising at least one straight section and an arcuate portion 15 joining the rear of the top portion to the top of the rear portion. In the example the arcuate portion 15 is composed of two arcuate sections.

On the arches 11 are mounted seating, or standing. structures 16. Stairways 17 are provided at each end and at the centre. Access stairs 18 are provided at each end. The space beneath the arches can be subdivided as by curtains or walls 19.

Figure 1:
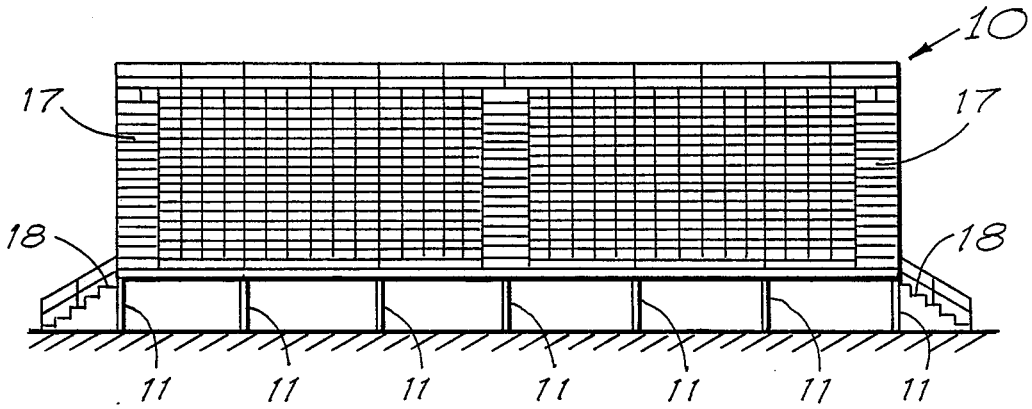
FIG. 1 is a front view of a stand.
Figure 3:
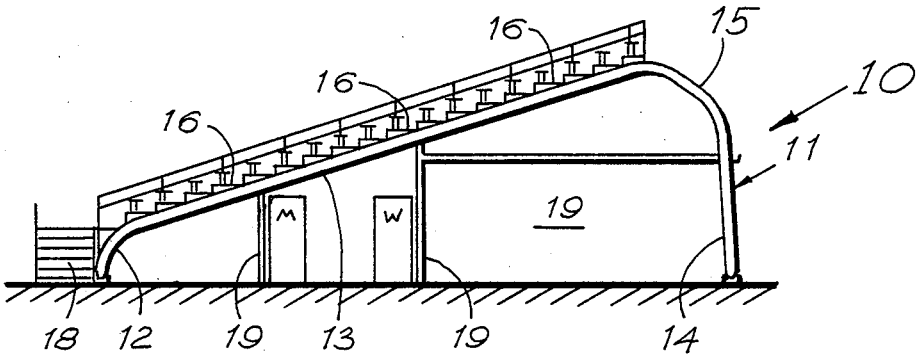
FIG. 3 is an end view of the stand in FIGS. 1 and 2.
Figure 2:
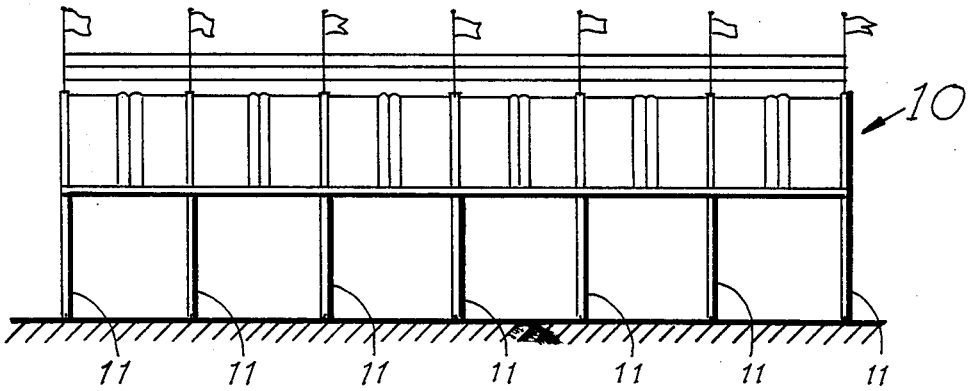
FIG. 2 is a back view of a stand.
Figure 4:
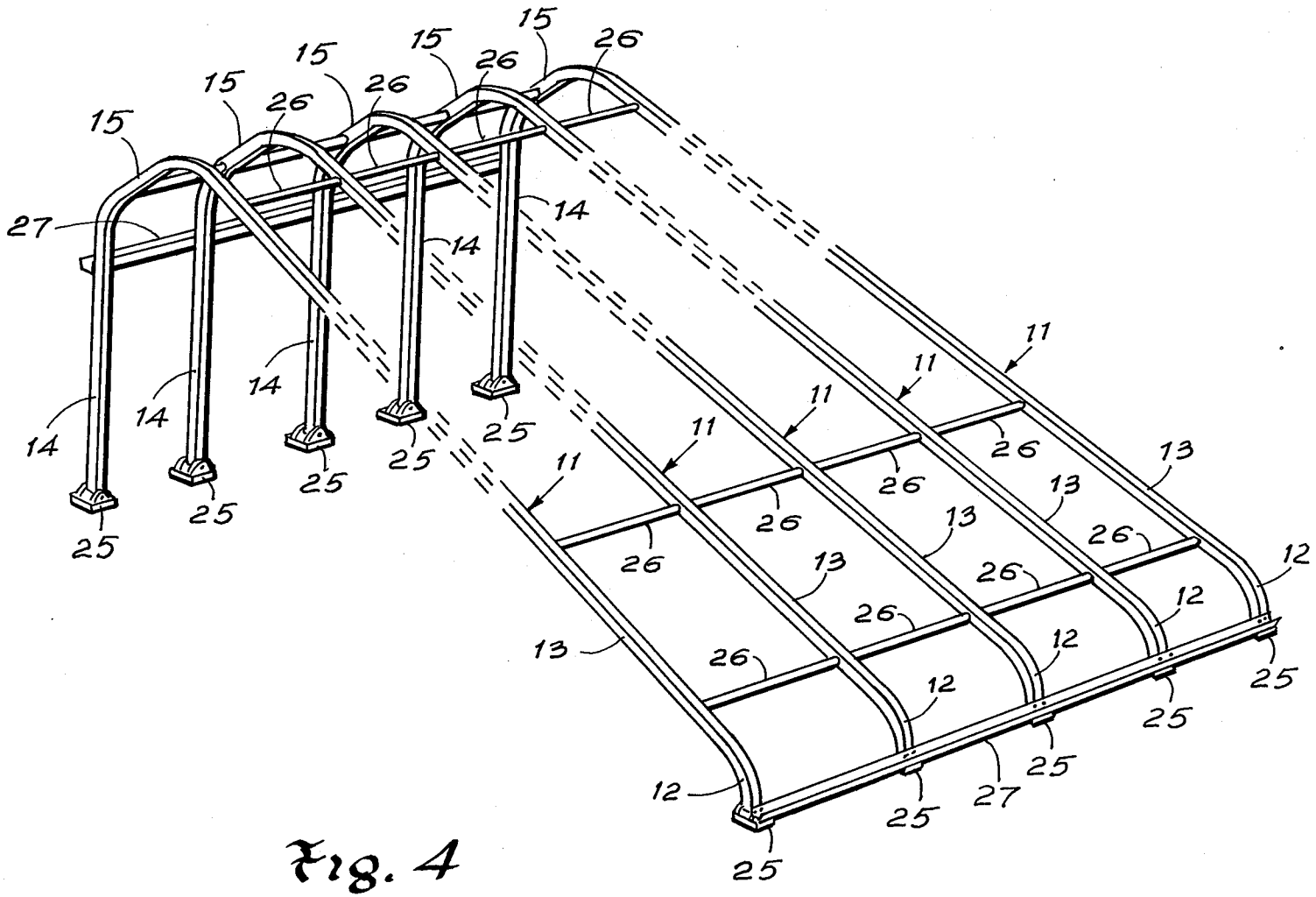
FIG. 4 is a perspective view of a number of arches or frames erected.

FIG. 4 illustrates part of a basic structure, having five arches 11. The arches are pivotally attached to ground plates 25 at each end and are held in spaced relationship by spacers or ties 26. A gutter 27 can be provided at the ground level at one end of the arches, the gutter at the other end being elevated to provide easy access beneath the arches.

FIGS. 5, 6, 7 and 8 illustrate the mounting of seat members. One each arch 11 is mounted a longitudinally extending pillar 30. A pillar extends across one or more pairs of arches. On each arch are mounted two plates 31, the plates being attached by bolts 32 securing nuts positioned in grooves 33 in the top surfaces of the arche. The grooves 33 will be described in more detail later. The pillars 30, of a hollow, somewhat trapezoidal cross-section, have flanges 34 along their lower edges, and bolts and nuts are used to secure the flanges 34 to the plates 31 via holes 35 in flanges and plates. The pillars 30 are spaced apart up the top portion of each arch a sufficient distance apart to provide a footwalk or floor between pillars. Extending between pillars are support members 36. Members 36 have hook shaped extensions 37, at each end, and these hook into slot 38 in the walls of the pillars. Floor members 39 rest on the support members 36.

Mounted on top of the pillars 30, are seat support members 40. In the example, a seat support member 40 is mounted on each pillar 30 above an arch 11. A seat member 41 rests on the seat support members. The support members 40, and seat members 41, are attached to the pillars by long bolts 42 which pass through the seat member, seat support member and a plate 43, into nuts that slide into slots 45a in the top surfaces of the pillars. The plates 43 locate the bottoms of the seat support members on the pillars.

Figure 5:
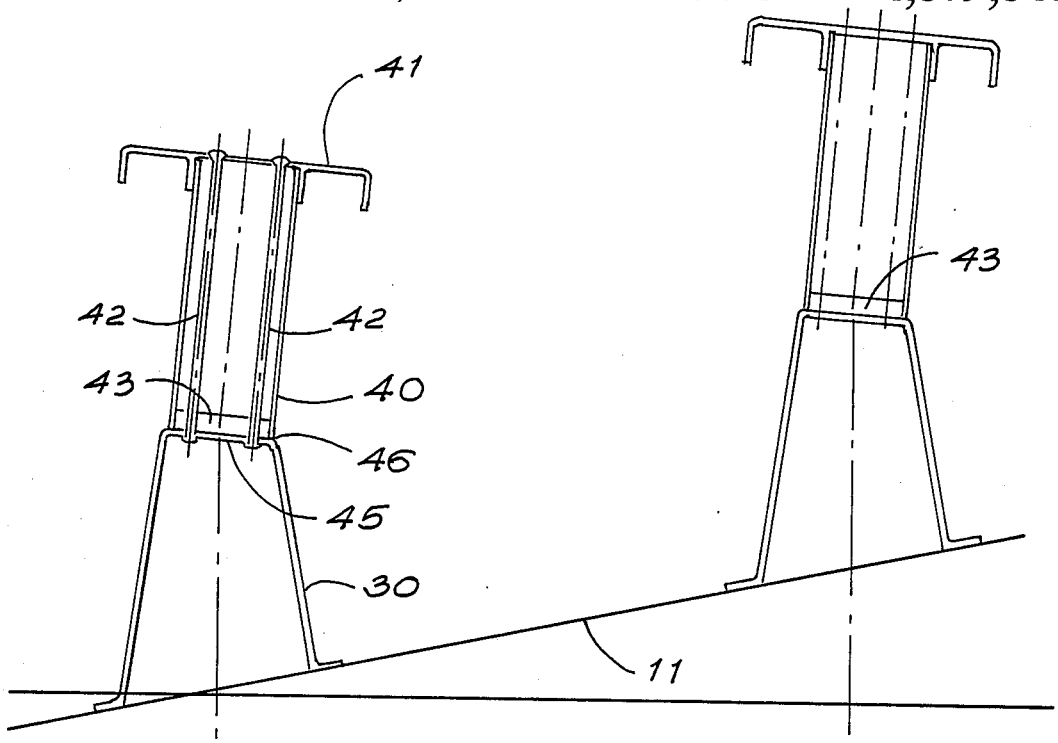
FIG. 5 is a cross-section through part of an arch or frame showing two pillars and seat members, for one inclination.
Figure 6:
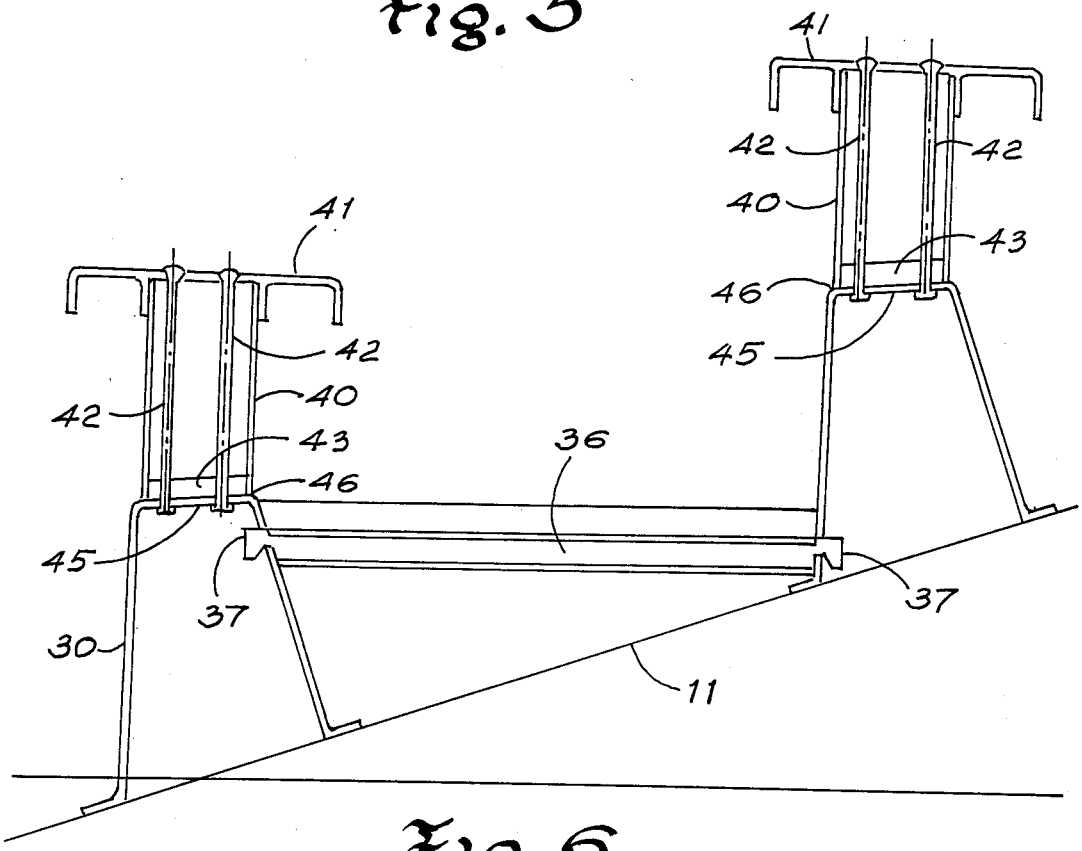
FIG. 6 is a similar view to that of Fiugre 5, showing an alternate inclination.

The arches may be assembled to give alternate angles of inclination of the top portions 13. This can be obtained by varying the number of sections in the rear portions 14, for example adding an extra straight section for an increased angle. Generally two alternate angles can be provided. To accommodate these alternate angles, the top surfaces 45 of the pillars and the bottoms 46 of the seat support members 40 are inclined or angled. Each is inclined at half the difference between the two angles of inclination of the arch. As an example, if the two angles are 11.2° and 18.4°, then the difference is 7.2°. The inclination of the bottoms 46 of the support members 40 and the top surfaces 45 of the pillars is each 3.6°. By reversing the seat support members 40 on the pillars, so the different inclinations of the arch can be accommodated to give a level seat member. FIG. 5 show the inclination at the lower angle while FIG. 6 shows the higher angle of inclination. The seat support member 40 are reversed in FIG. 6 relative to the situation in FIG. 5.

Figure 8:
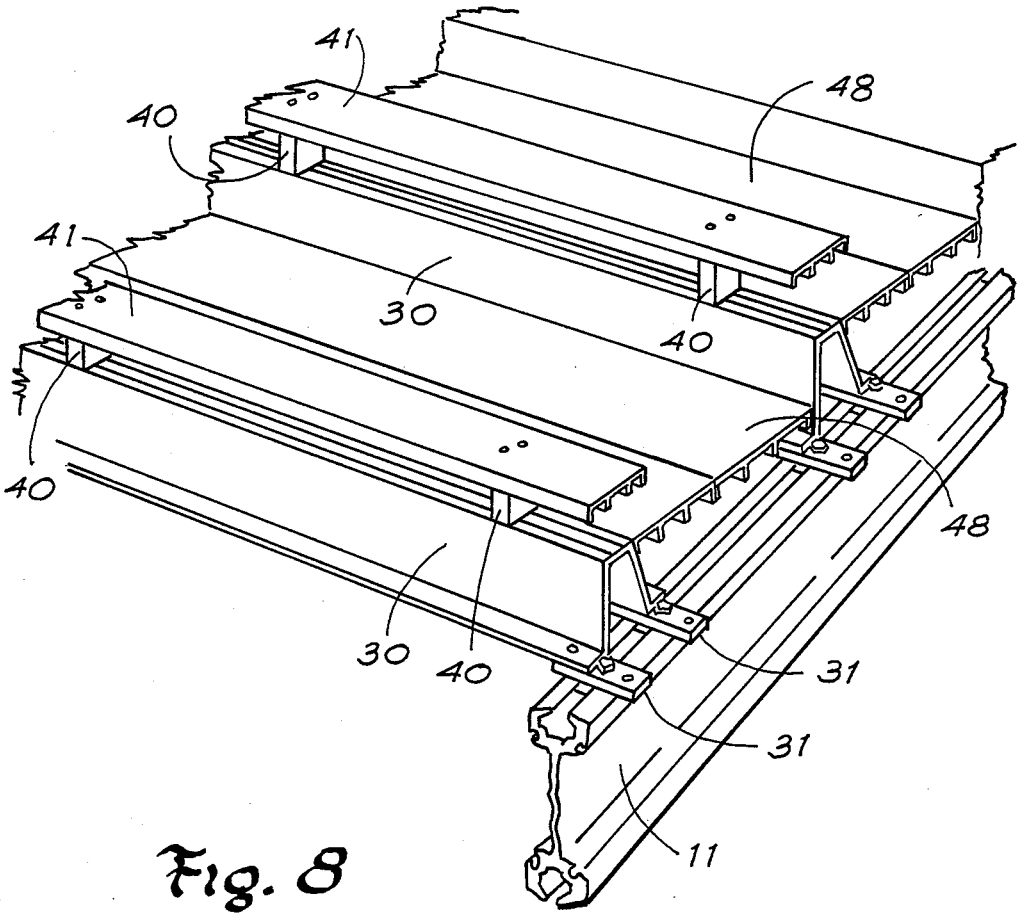
FIG. 8 is a perspective view of an arch or frame with pillars, seat members and floor members assembled.

FIG. 8 shows seat members 41 mounted on the pillars 30, and floor members 48 positioned on the support members. In the example the floor members are of an extruded form, for example of an aluminum alloy. However other materials, for example wood, can be used.

Figure 9:
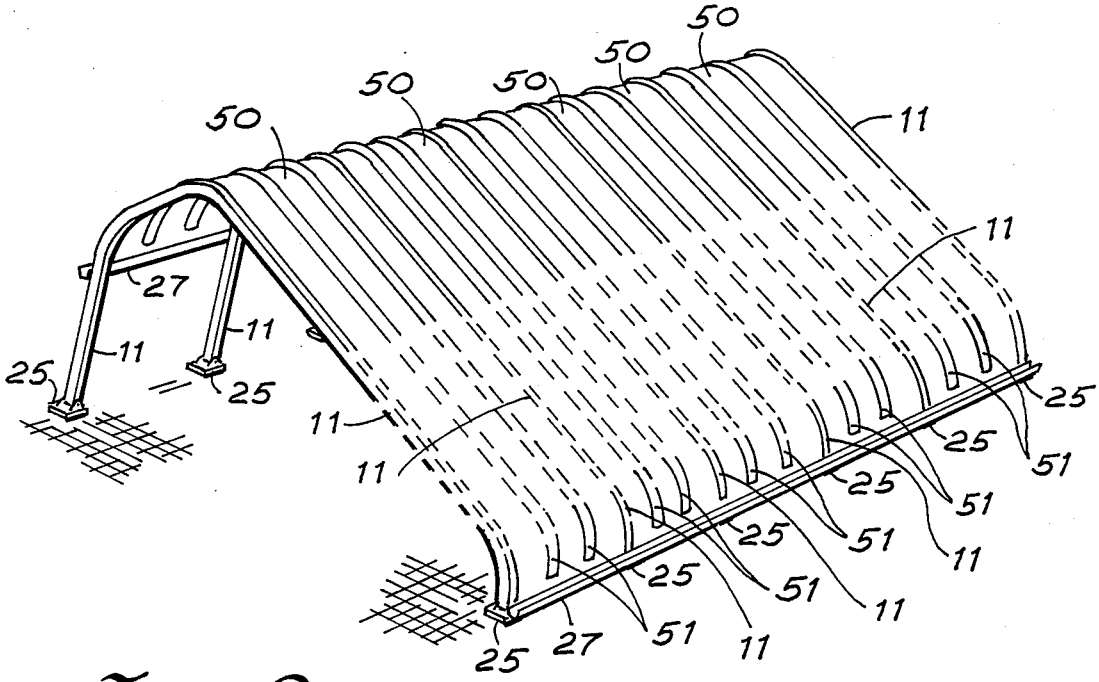
FIG. 9 is a perspective view similar to that of FIG. 4 but showing fabric panels inserted between arches or frames.

While the pillars 30 and the floor members 48 form a reasonably continuous roof or covering for the arches, it is likely that rain and dust will be able to fall through various gaps. Therefore, to ensure a complete leakproof covering it is possible to install fabric panels between arches. The fabric panels can be installed by feeding roped edges of a panel into key hole shaped grooves or slots in the sides of the arches. This is illustrated in U.S. Pat. No. 4,583,331. After installation the panels are tightened by inflating tubes integral with the panels. FIG. 9 illustrates a structure, having arches 11, and fabric panels 50 extending between the arches. The panels are tightened by inflation of the integral tubes 51.

Figure 10:
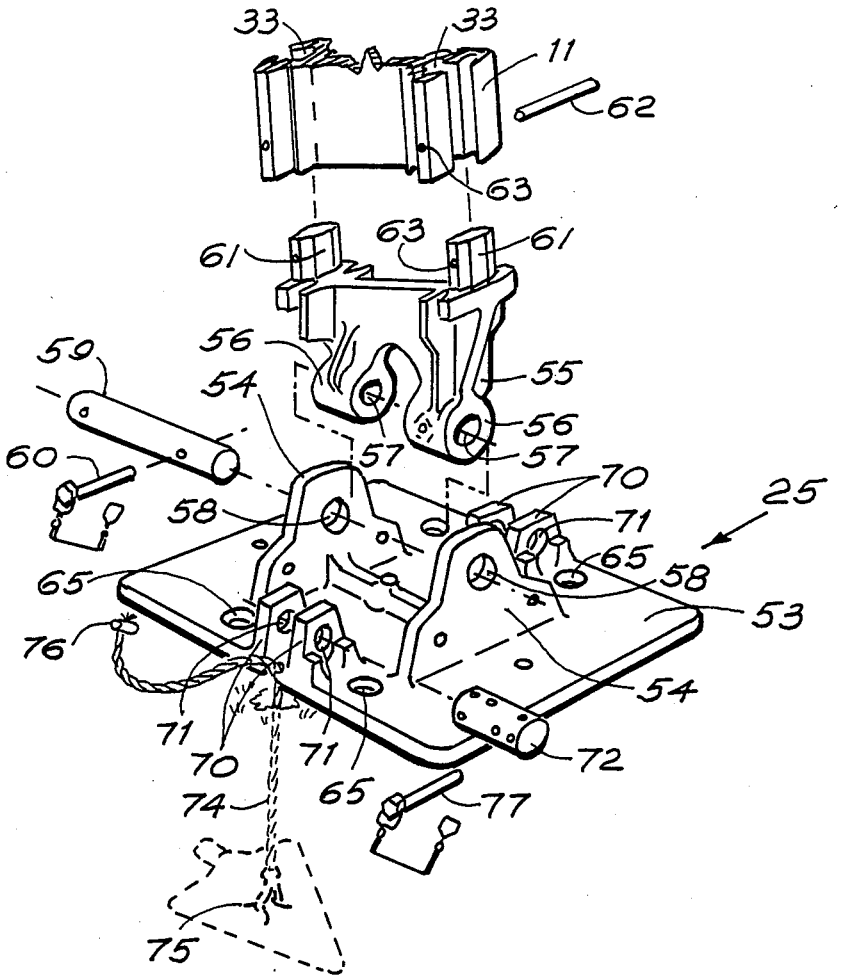
FIG. 10 is an exploded perspective view of one form of ground anchor.

As previously stated, the arches are pivotally mounted at their lower ends on ground plates or anchors. FIG. 10 illustrates one form of such a ground plate. The plate, indicated generally at 52, comprises a base plate 53 having a pair of upstanding ribs 54. Between the ribs 54 fits a bracket 55, having two bearings 56. The bores 57 of the bearings 56 align with holes 58 in the ribs 54. A hinge pin 59 passes through holes 58 and the bores 57. A locking pin 60 extends through a transverse hole in one of the bearings 56 and the hinge pin 59. The bracket 55 has two spaced projections 61 which are shaped and positioned to fit into grooves 33 (FIG. 7) in the flanges of the arches 11. Locking pins 62 pass through holes 63 in the flanges of the arches and the projections 61.

The base plate 53 has holes 65 through which can be driven ground spikes, or through which can pass ground bolts screwing into an anchor in the ground, depending upon the desired level of fixing and the form of surface the structure is assembled on. For relatively long term holding, deeply driven ground anchors can be used. These anchors are connected to the ground plate by cables or similar means. A problem can arise if an anchor hits rock or if there is some impediment to deep driving. In the example, two pairs of small ribs 70 are provided, a pair at each side of the base plate. Aligned bores 71 in the ribs 70 hold a rotatable pin 72. Pin 72 has a series of holes 73. A cable 74 is connected at one end to a ground anchor, shown dotted at 75. At its other end the cable has a short pin 76 which can be inserted into one of the holes 73. A further pin 77 can be inserted in one of a plurality of holes 78 extending through the pin 72. The pin 72 is installed in the ribs 70, pin 77 inserted into one of the holes 78, and the pin 72 rotated by pin 77. Spare cable will be wound up on pin 72, which is rotated until the cable is taut. A further pin 77 can then be inserted into a hole 78 to prevent unwinding. It is possible to use a longer pin 77 to wind up the cable, a short pin only being used to lock the pin 72 in position.

Figure 11:
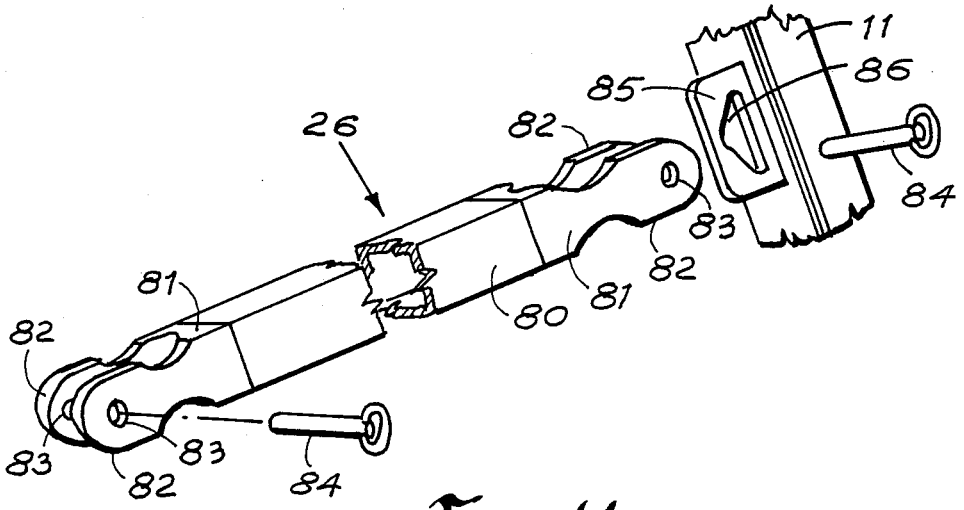
FIG. 11 is an exploded perspective view of a spacing and tie bar.

FIG. 11 illustrates one form of spacer or tie 26. In this example, a spacer comprises a main tabular portion 80 into each end of which is fitted a pivot member 81 having two spaced parallel legs 82. Each leg has a hole 83, the holes aligned, for reception of a pin 84. Pins 84 connect the spaces 26 to the arches via a bracket 85 attached to each arch 11. The brackets have a slot 86 through which passes the pins 84. The slots provide for some sliding of a pin during erection. It is possible to have fixed pivot points only if all the pivots are on the centre lines of the anchors.

Figure 7:
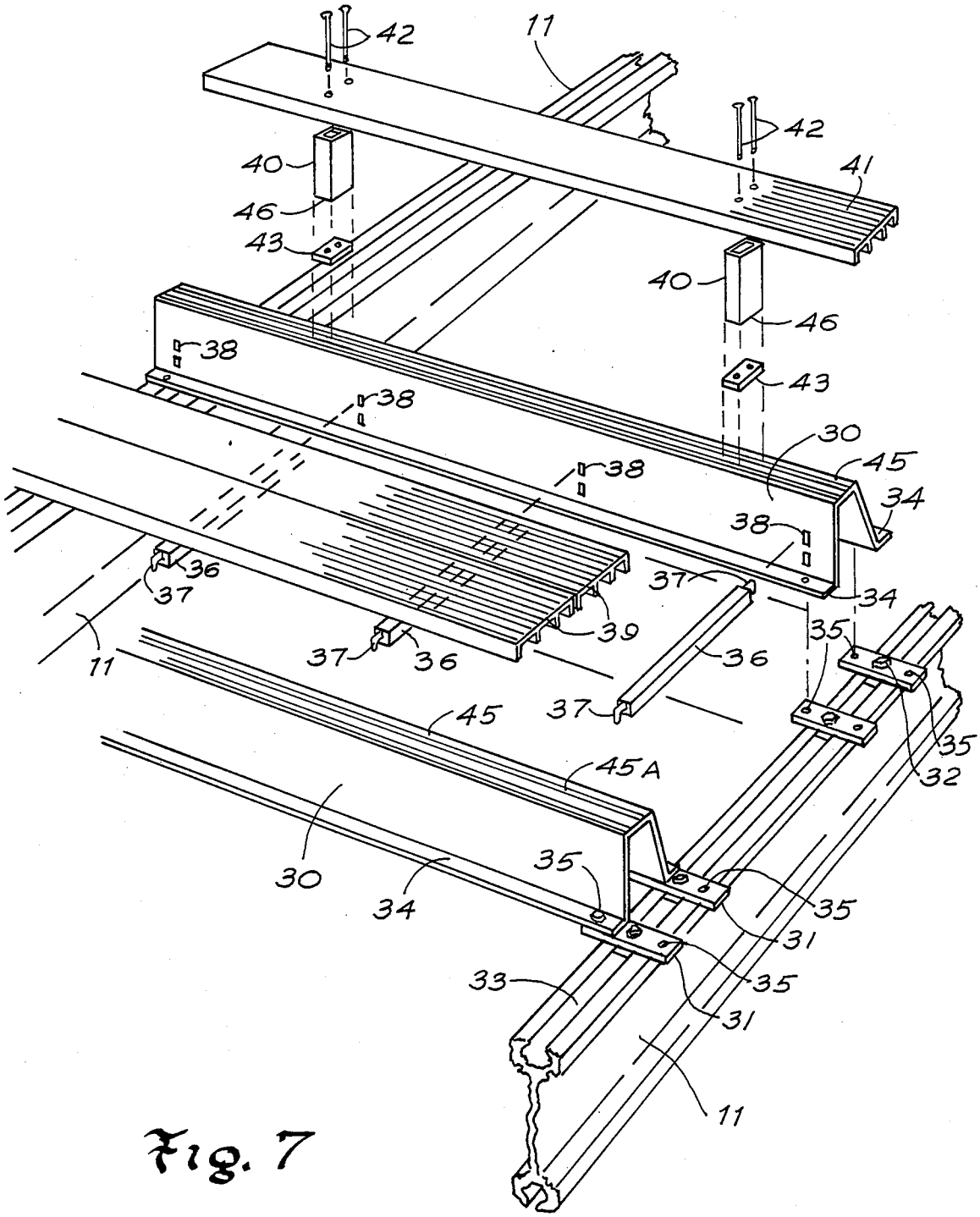
FIG. 7 is a perspective exploded view of an arch or frame pillars and seat members.
Figure 12:
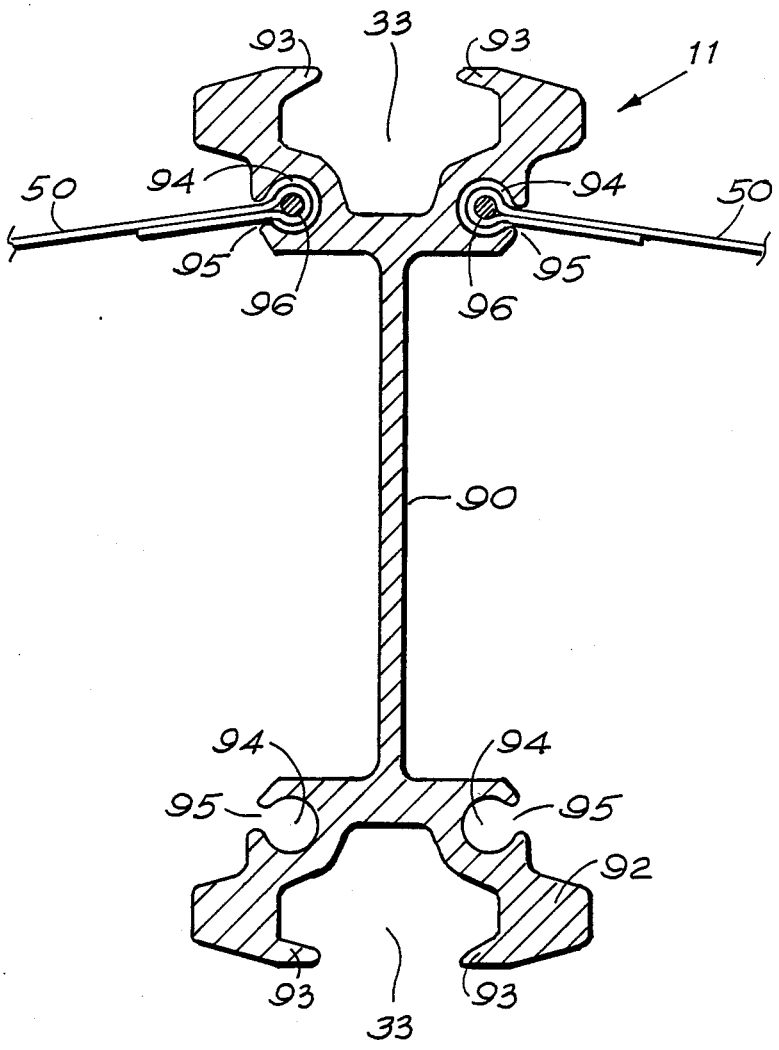
FIG. 12 is a cross-section through a section of an anchor member, and also illustrating a method of attaching fabric panels.

FIG. 12 illustrates one form of cross-section for the arches 11. The cross-section is in the form of an I-beam, having a central web 90 with flanges 91 and 92, at the ends of the web 90. The flanges 91 and 92 are relatively thick and have a central groove 33, as shown in FIGS. 7 and 8. The grooves 33 have a restricted opening, defined by the inwardly projecting ribs 93. At the junctions of the flanges 91 and 92 with the rib 90, on each side of the web, are substantially circular grooves 94, each having a narrow neck 95 giving access to the groove, the grooves thus having a keyhole formation. The central grooves 33 accept nuts onto which fastening members such as bolts can screw. This provides for the attachment of the plates 31 on the outer flanges of the anchors. On the inner flanges can be attached screens, lights and other items as desired. Power, telephone and the like cables can be run in the grooves 33.

As described earlier, fabric panels can be inserted between arches, for example by positioning roped edges of the panels in grooves. FIG. 12 illustrates panels 50, as in FIG. 9, having roped edges 96 inserted in the grooves 94. Additional panels can be inserted in the inner grooves 94. The outer panels can be for enclosure, and weatherproofing while the inner panels can be for giving a more aesthertic appearance, for example.

Figure 13:
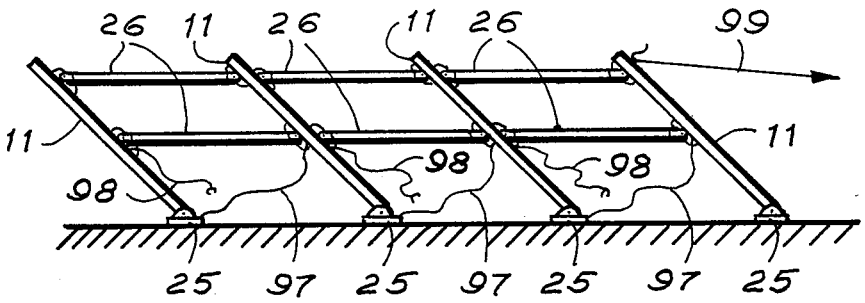
FIG. 13, 14 and 15 illustrate various stages of erecting arches or frames.
Figure 14:
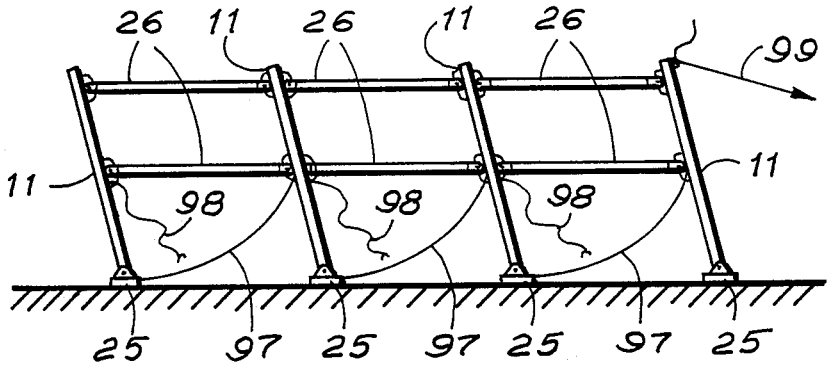
Figure 15:
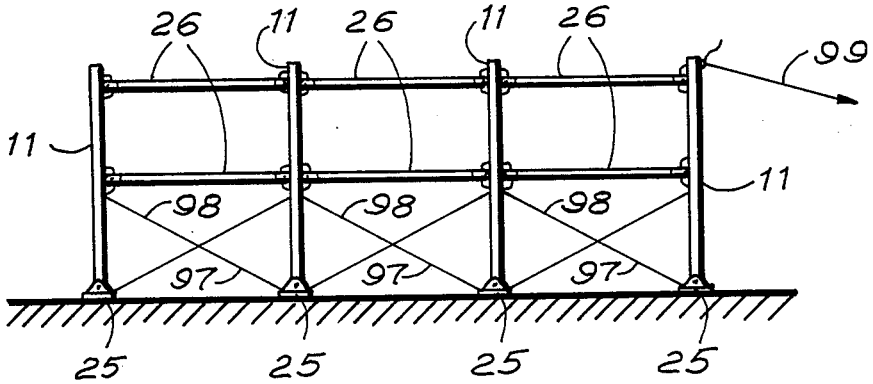

FIGS. 9, 10 and 11 illustrate various stages in one method of erecting arches. The arches 11 are assembled on the ground and their bottom ends pivotally attached to the ground plates 25. Spacer or tie bars 26 are attached. Also cross-bracing wires 97 and 98 are attached. At first only the wires 97 can be attached at both ends. By pulling on a cable 99 the arches are pivotted up, through the stages shown in FIGS. 13 and 14 to a fully erected condition as in FIG. 15. The cross bracing wires 98 are attached at the other ends. Provision can be made in the cross-bracing wires of tightening the wires after erected, for example by turnbuckles.

Once the arches are erected,the pillars 30 and support members 36 are installed, followed by the floor members 41, seat support members 40 and seats 41. Steps are provided at each end and at the center for example, for each section, and stairs positioned at each end for access to the lowest part of the steps.

It may not be necessary to provide the cross-wire braces 97 and 98, as considerable lateral stability is provided by the pillars, seat support members and floor members.

Contrary to conventional structures, the structure of the present invention provides an unobstructred area beneath the seats. Completely unrestricted access to the space beneath the seats is possible at each end and very easy access is available at the rear, restricted only by the rear portions of the arches 11. Thus space is available for a variety of uses: food concessions, washrooms, changing rooms, exhibits and other uses.

What is claimed is:

1. A viewing structure comprising a plurality of parallel arched frames pivot means at each end of each frame, the pivot means at each end of a frame having a common axis; each frame having front, top and rear portions; said front portion comprising an arcuate section, said top portion comprising a plurality of straight sections and said rear portion comprising at least one straight section; the top portion joined at its front end to the top of said front portion and joined at its rear end to the top of the rear portion the top portion inclined upwardly and rearward at a predetermined angle; a plurality of support pillars mounted on each top portion, spaced apart thereon; seating members mounted on top of the pillars and extending transversely of said arches; and floor members mounted between said pillars.

2. A structure as claimed in claim 1, including support members extending between said pillars, normal to said seating members, said floor members mounted on said support members.

3. A structure as claimed in claim 1, including an arcuate portion joining said rear end of said top portion to the top of the rear portion.

4. A structure as claimed in claim 3, said arcuate portion comprising two arcuate sections.

5. A struture as claimed in claim 1, said top portions inclined upwardly and rearwardly at either of two predetermined angles.

6. A structure as claimed in claim 5, top surfaces of said pillars being inclined at an angle equal to half the difference between said two predetermined angles.

7. A structure as claimed in claim 6, said seating members including a bottom surface, said bottom surface inclined at an angle equal to half the difference between said two predetermined angles.

8. A structure a claimed in claim 7, each said seating member including a seat support member mounted on each pillar and a longitudinally extending seat mounted on top of said seat support members, said bottom surface being a bottom surface on each seat support member.

9. A structure as claimed in claim 5, said rear portion comprising a first predetermined number of straight sections for a first of said two predetermined angles, and comprising a second predetermined number of straight sections for the second of said two predetermined angles.

10. A structure as claimed in claim 1, including fabric panels extending between the arched frames.

11. A structure as claimed in claim 10, said fabric panels including integral lateral tensioning means.

12. A structure as claimed in claim 11, said tensioning means comprising inflatable tube portions.

13. A structure as claimed in claim 10, said fabric panels extending for said top portion.

14. A structure as claimed in claim 1, including means subdividing the space beneath the arched frames.

15. A structure as claimed in claim 1, including stairs on said top portion.

16. A structure as claimed in claim 1, all of said sections having a common cross-section.

* * * * *